US008511267B2

(12) United States Patent
Takemura et al.

(10) Patent No.: US 8,511,267 B2
(45) Date of Patent: Aug. 20, 2013

(54) VARIABLE VALVE DEVICE AND INTERNAL COMBUSTION ENGINE

(75) Inventors: Shinichi Takemura, Fujisawa (JP); Toru Fukami, Kawasaki (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 228 days.

(21) Appl. No.: 12/672,809

(22) PCT Filed: Aug. 8, 2008

(86) PCT No.: PCT/JP2008/064618

§ 371 (c)(1),
(2), (4) Date: Feb. 9, 2010

(87) PCT Pub. No.: WO2009/022734

PCT Pub. Date: Feb. 19, 2009

(65) Prior Publication Data

US 2011/0180028 A1 Jul. 28, 2011

(30) Foreign Application Priority Data

| | | |
|---|---|---|
| Aug. 10, 2007 | (JP) | 2007-209706 |
| Aug. 21, 2007 | (JP) | 2007-214529 |
| Feb. 25, 2008 | (JP) | 2008-043126 |
| Feb. 28, 2008 | (JP) | 2008-047918 |

(51) Int. Cl.
*F01L 1/34* (2006.01)

(52) U.S. Cl.
USPC ..... 123/90.16; 123/90.39

(58) Field of Classification Search
USPC ..... 123/90.15, 90.16, 90.39
See application file for complete search history.

(56) References Cited

U.S. PATENT DOCUMENTS

| | | | | |
|---|---|---|---|---|
| 5,937,809 | A | 8/1999 | Pierik et al. | |
| 6,019,076 | A | 2/2000 | Pierik et al. | |
| 6,041,746 | A * | 3/2000 | Takemura et al. | 123/90.16 |
| 6,390,035 | B2 | 5/2002 | Moteki et al. | |
| 6,561,148 | B2 | 5/2003 | Moteki et al. | |
| 6,694,935 | B2 | 2/2004 | Miyazato et al. | |
| 7,152,560 | B2 | 12/2006 | Miyanoo et al. | |

(Continued)

FOREIGN PATENT DOCUMENTS

| | | | |
|---|---|---|---|
| CN | 1657746 | A | 8/2005 |
| DE | 10109234 | A1 | 9/2001 |

(Continued)

OTHER PUBLICATIONS

U.S. Appl. No. 12/672,801, filed Feb. 9, 2010, Fukami et al.

(Continued)

*Primary Examiner* — Zelalem Eshete
(74) *Attorney, Agent, or Firm* — Foley & Lardner LLP

(57) ABSTRACT

While an operating angle or a lift of an engine valve (211) is modified within a predetermined operating angle range or lift range, variation in an opening timing of the engine valve (211) is suppressed by displacing a rocker shaft (216*b*) relative to a drive shaft (213) such that an opening timing variation of the engine valve (211) accompanying angular variation in a straight line linking a center of the drive shaft (213) and a center of the rocker shaft (216*b*) and an opening timing variation of the engine valve (211) accompanying variation in a distance between the center of the drive shaft (213) and the center of the rocker shaft (216*b*) cancel each other out.

19 Claims, 14 Drawing Sheets

(56) References Cited

U.S. PATENT DOCUMENTS

| | | | | |
|---|---|---|---|---|
| 7,246,578 | B2 | 7/2007 | Nakamura et al. | |
| 7,748,356 | B2 * | 7/2010 | Meyer et al. | 123/90.16 |
| 2001/0027762 | A1 | 10/2001 | Moteki et al. | |
| 2002/0007809 | A1 | 1/2002 | Miyazato et al. | |
| 2002/0108592 | A1 * | 8/2002 | Takemura et al. | 123/90.17 |
| 2005/0178350 | A1 | 8/2005 | Nakamura et al. | |

FOREIGN PATENT DOCUMENTS

| | | | |
|---|---|---|---|
| EP | 1026370 | A2 | 8/2000 |
| EP | 1236870 | A2 | 9/2002 |
| EP | 1258601 | A2 | 11/2002 |
| JP | 11-324625 | A | 11/1999 |
| JP | 2001-55915 | A | 2/2001 |
| JP | 2001-227367 | A | 8/2001 |
| JP | 2001-329871 | A | 11/2001 |
| JP | 2002-38913 | A | 2/2002 |
| JP | 2002-89341 | A | 3/2002 |
| JP | 2002-256905 | A | 9/2002 |
| JP | 2003-90235 | A | 3/2003 |
| JP | 2003-343224 | A | 12/2003 |
| JP | 2004-60635 | A | 2/2004 |
| JP | 2005-113720 | A | 4/2005 |
| JP | 2005-291007 | A | 10/2005 |
| JP | 2006-37812 | A | 2/2006 |
| JP | 2006-329022 | A | 12/2006 |
| JP | 2006-329023 | A | 12/2006 |
| JP | 2007-009705 | A | 1/2007 |
| JP | 2007-162706 | A | 6/2007 |
| JP | 2007-231909 | A | 9/2007 |
| JP | 2007-332943 | A | 12/2007 |

OTHER PUBLICATIONS

Toru Fukami et al., USPTO Non-Final Office Action, U.S. Appl. No. 12/672,801, Aug. 2, 2012, (12 pgs.).

Toru Fukami et al., US PTO Notice of Allowance on U.S. Appl. No. 12/672,801 DTD Feb. 19, 2013, (10 pgs.).

* cited by examiner

VARIABLE VALVE DEVICE AND INTERNAL COMBUSTION ENGINE

TECHNICAL FIELD

This invention relates to variable valve control in an internal combustion engine.

BACKGROUND ART

JP2002-256905A, published by the Japan Patent Office in 2002, discloses a variable valve device that can increase and reduce an operating angle or a lift of an intake valve continuously and retard and advance a lift central angle continuously.

DISCLOSURE OF THE INVENTION

In this conventional variable valve device, when the operating angle or lift of the intake valve is increased, an opening timing of the intake valve is invariably advanced. Therefore, when the operating angle or lift of the intake valve is increased, interference is likely to occur between the intake valve and a piston in the vicinity of top dead center. To prevent interference between the valve and the piston, measures such as providing the piston with a valve recess must be taken.

It is therefore an object of this invention to provide a variable valve device with which the likelihood of interference between a valve and a piston is suppressed.

To achieve the object described above, a variable valve device according to this invention includes a drive shaft that rotates in synchronization with a crankshaft of an engine, a drive cam provided on the drive shaft, a rocker cam supported on the drive shaft to be free to rock, an engine valve that is driven to open and close by a rocking motion of the rocker cam, a rocker shaft disposed parallel to the drive shaft, a rocker arm supported on the rocker shaft to be free to rock, a first link that links the rocker arm and the drive cam; a second link that links the rocker arm and the rocker cam, and rocker shaft position modifying means for modifying an operating angle or a lift of the engine valve by varying a position of the rocker shaft relative to the drive shaft. In the variable valve device, these members are constituted such that an opening timing of the engine valve is retarded when the operating angle or the lift of the engine valve is increased.

Alternatively, these members of the variable valve device are constituted such that by displacing the rocker shaft relative to the drive shaft while the operating angle or lift of the engine valve is modified within a predetermined operating angle range or lift range, an opening timing variation of the engine valve accompanying angular variation in a straight line linking a center of the drive shaft and a center of the rocker shaft when the engine is seen from a front surface thereof and an opening timing variation of the engine valve accompanying variation in a distance between the center of the drive shaft and the center of the rocker shaft cancel each other out, whereby variation in an opening timing of the engine valve is suppressed.

Alternatively, these members of the variable valve device are constituted such that when the operating angle or lift of the engine valve increases, a lift/operating angle center moves toward a retardation side, and an amount by which the operating angle center moves toward the retardation side relative to the increase in the operating angle or lift is larger in a range where the operating angle or lift is greater than a predetermined operating angle or lift than in a range where the operating angle or lift is smaller than the predetermined operating angle or lift.

The details as well as other features and advantages of this invention are described in the following description of the specification and illustrated in the attached drawings.

BEST MODES FOR CARRYING OUT THE INVENTION

Figure 1:
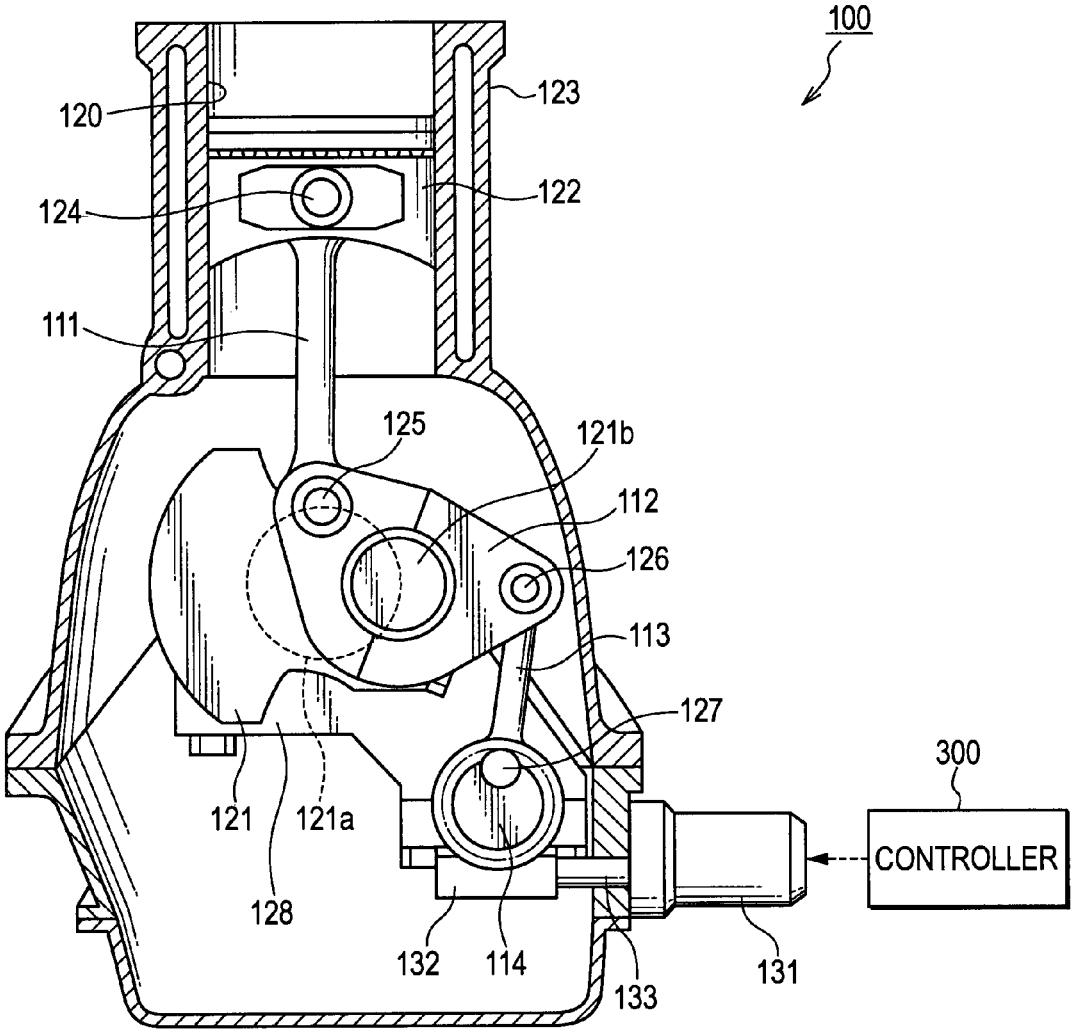
FIG. 1 is a schematic longitudinal sectional view of a variable compression ratio engine to which this invention is applied.

Referring to FIG. 1, an internal combustion engine 100 comprises a variable compression ratio mechanism that modifies a compression ratio continuously by varying a piston stroke. A multi-link variable compression ratio mechanism disclosed in JP2001-227367A is applied as the variable compression ratio mechanism. Hereafter, the internal combustion engine 100 including this multi-link variable compression ratio mechanism will be referred to as a "variable compression ratio engine 100".

In the variable compression ratio engine 100, a piston 122 and a crankshaft 121 are connected via an upper link 111 and a lower link 112.

An upper end of the upper link 111 is connected to the piston 122 via a piston pin 124, and a lower end thereof is connected to one end of the lower link 112 via a connecting pin 125. The piston 122 is fitted slidably into a cylinder 120 formed in a cylinder block 123, and performs a reciprocating motion inside the cylinder 120 upon reception of combustion pressure.

One end of the lower link 112 is connected to the upper link 111 via the connecting pin 125, and another end thereof is connected to one end of a control link 113 via a connecting pin 126. Further, a crank pin 121*b* of the crankshaft 121 penetrates a connecting hole positioned substantially in the center of the lower link 112 such that the lower link 112 rocks using the crank pin 121*b* as a central axis. The lower link 112 may be divided into left and right members. The crankshaft 121 includes a plurality of journals 121*a* and a plurality of the crank pins 121*b* disposed alternately in an axial direction. The journals 121*a* are supported by the cylinder block 123 and a rudder frame 128 to be free to rotate. The crank pins 121*b* are fixed to the journals 121*a* in positions offset from the journals 121*a* by a predetermined amount.

An end portion of the control link 113 on the opposite side to the connecting pin 126 is connected to a control shaft 114 via a connecting pin 127. The connecting pin 127 connects the control link 113 to the control shaft 114 in an offset position from a center of the control shaft 114. A gear is formed on the control shaft 114, and the gear is meshed to a pinion 132 provided on a rotary shaft 133 of a compression ratio modification actuator 131. The control shaft 114 is rotationally displaced in accordance with rotation of the compression ratio modification actuator 131, causing the position of the connecting pin 127 to vary.

Next, a compression ratio modification method of the variable compression ratio engine 100 will be described.

Figure 2C:
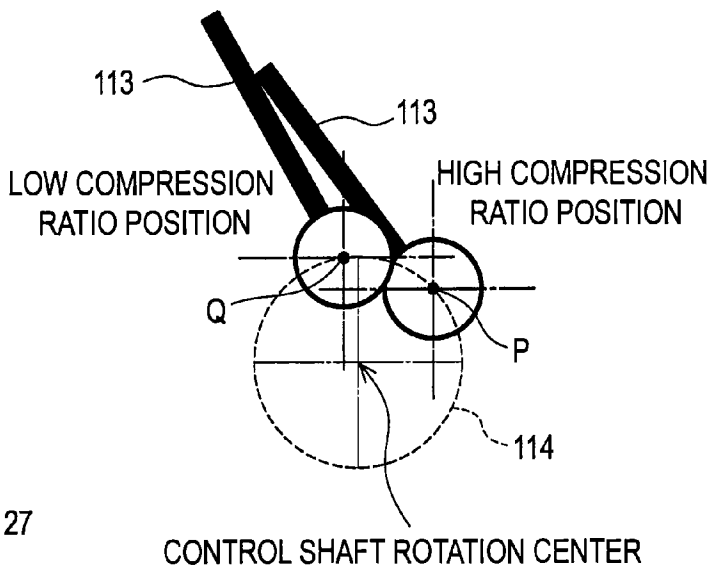
FIGS. 2A to 2C are views illustrating compression ratio variation in the variable compression ratio engine.
Figure 2B:
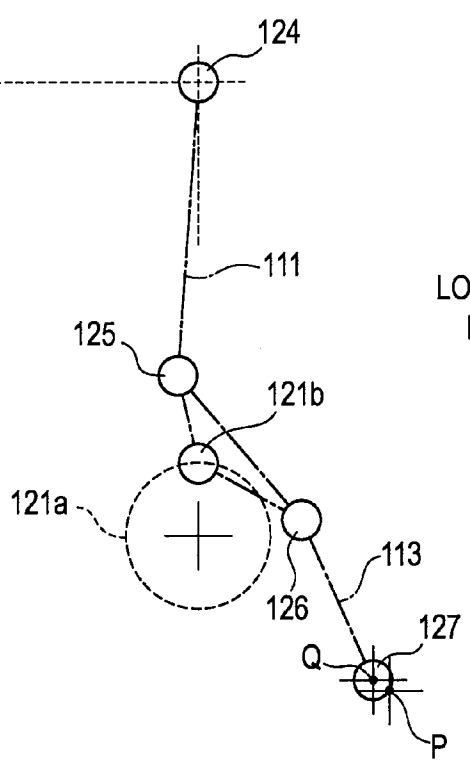
Figure 2A:
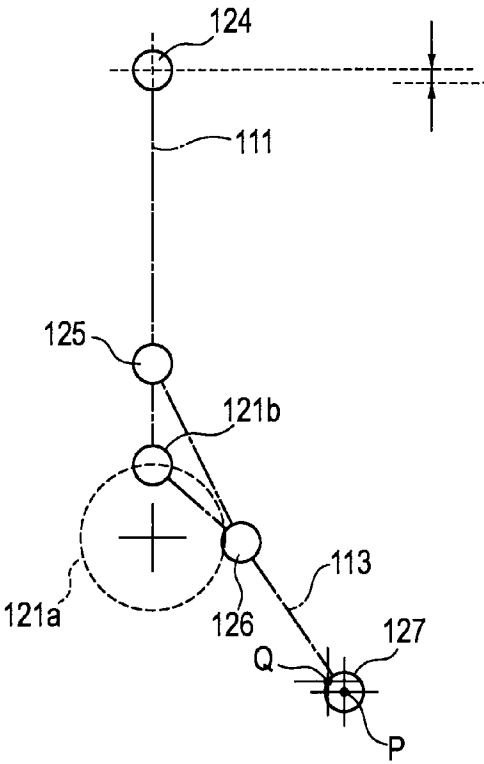

Referring to FIGS. 2A to 2C, when the connecting pin 127 is in a position P, a top dead center (TDC) position of the piston 122 rises, leading to an increase in the compression ratio.

When the connecting pin 127 is in a position Q, the control link 113 is pushed upward such that the position of the connecting pin 126 rises. Accordingly, the lower link 112 rotates in a counter-clockwise direction about the crank pin 121*b*, and as a result, the connecting pin 125 falls, causing the top dead center position of the piston 22 to fall. Hence, the compression ratio decreases.

Figure 3:
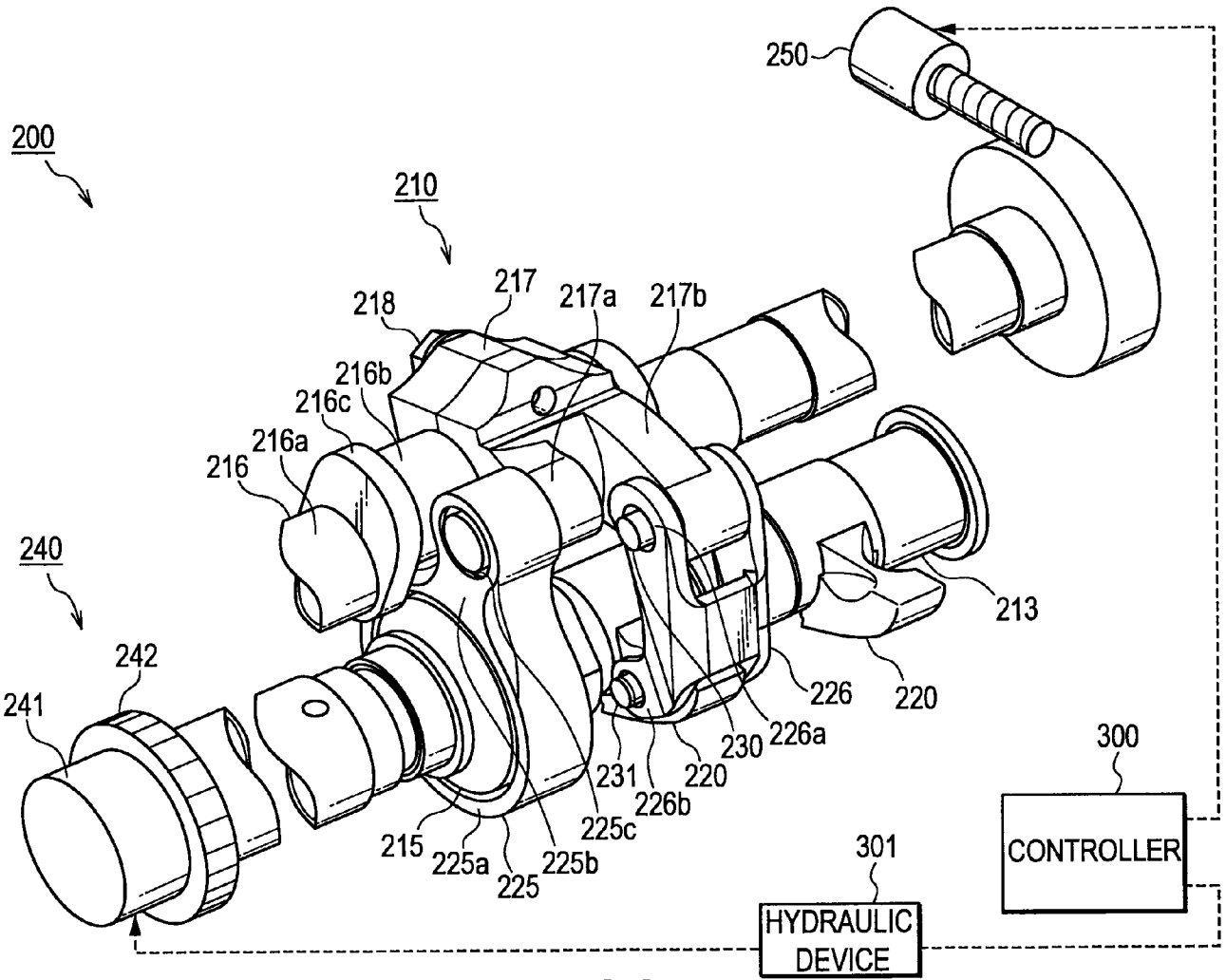
FIG. 3 is a perspective view showing an intake valve variable valve device provided in the variable compression ratio engine.
Figure 4:
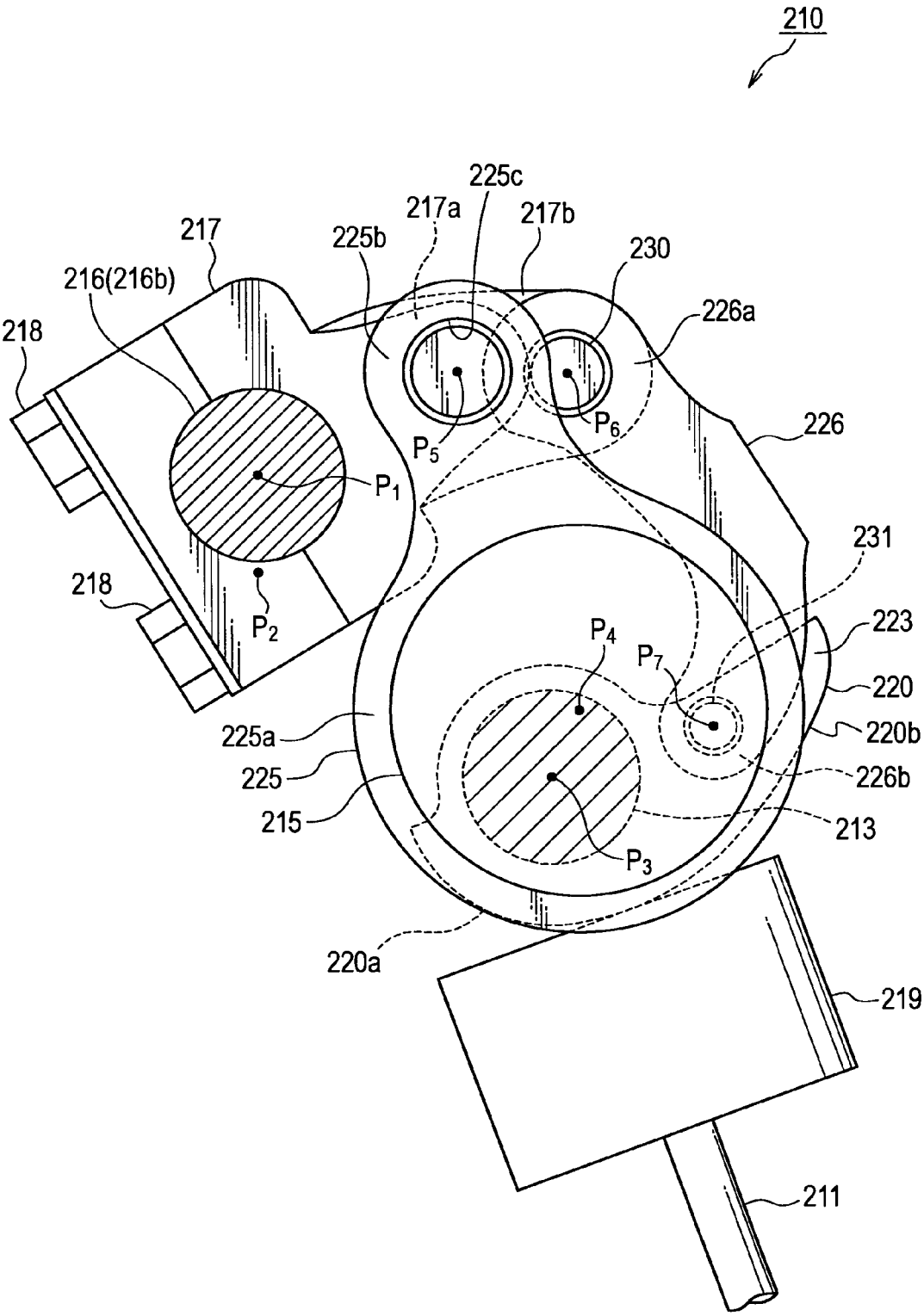
FIG. 4 is a side view of a variable lift/operating angle mechanism according to this invention, which constitutes a part of the intake valve variable valve device.

Referring to FIG. 3 and FIG. 4, an intake valve variable valve device 200 provided in the variable compression ratio engine 100 will be described.

The intake valve variable valve device 200 comprises a variable lift/operating angle mechanism 210 that varies a lift/operating angle of an intake valve 211, and a variable phase mechanism 240 that advances or retards a phase of a lift central angle of the intake valve 211. The lift central angle is a crank angle at which the intake valve 211 reaches a maximum lift. For simplification, FIG. 3 shows only a pair of intake valves and related components thereof corresponding to a single cylinder.

First, the constitution and actions of the variable lift/operating angle mechanism 210 will be described.

Referring to FIG. 3, a hollow drive shaft 213 that is provided above the pair of intake valves parallel to the crankshaft and extends in a cylinder array direction is supported by a cylinder head in each cylinder of the variable compression ratio engine 100.

The drive shaft 213 is linked to the crankshaft by a belt or a chain via a sprocket 242 provided in one end portion thereof, and rotates in conjunction with the crankshaft.

Referring to FIG. 4, the drive shaft 213 rotates in a clockwise direction of the figure.

A pair of rocker cams 220 are supported by the drive shaft 213 in each cylinder to be free to rock relative to the drive shaft 213. When the pair of rocker cams 220 rock about the drive shaft 213 within a predetermined rotation range, a valve lifter 219 of the intake valve 211, which is positioned below a cam nose 223 of the rocker cam 220, is pressed such that the intake valve 211 is lifted downward. The pair of rocker cams 220 are integrated with each other via a cylindrical portion covering an outer periphery of the drive shaft 213, and therefore rock in phase.

A drive cam 215 is fixed to the drive shaft 213. The drive cam 215 is a circular eccentric cam having a center P4 that is offset from an axial center P3 of the drive shaft 213 by a predetermined amount. The drive cam 215 is fixed to the outer periphery of the drive shaft 213 by press-fitting the drive shaft 213 into an eccentric hole.

The drive cam 215 is provided in a position that is offset from the rocker cam 220 in an axial direction. A link arm 225 serving as a first link that connects the drive cam 215 to a rocker arm 217 is fitted onto an outer peripheral surface of the drive cam 215 to be free to rotate.

The link arm 225 includes a ring-shaped base portion 225*a* having a comparatively large diameter and a projecting portion 225*b* formed on a part of the base portion 225*a*. A pin hole 225*c* is drilled in the projecting portion 225*b*.

A crank-shaped control shaft 216 provided diagonally above the drive shaft 213 so as to extend in the cylinder array direction parallel to the drive shaft 213 is supported by the cylinder head to be free to rotate.

Returning to FIG. 3, the control shaft 216 includes a main shaft portion 216*a* supported by the cylinder head, a rocker shaft 216*b* that is offset from the main shaft portion 216*a* by a predetermined amount and provided parallel to the drive shaft 213 so as to support the rocker arm 217 rockably, and a connecting portion 216*c* that connects the main shaft portion 216*a* and the rocker shaft 216*b*.

The rocker arm 217, which is attached to an outer peripheral surface of the rocker shaft 216*b* to be free to rotate, is constituted by two divided members and attached to the periphery of the rocker shaft 216*b* by two bolts 218. The rocker arm 217 includes a connecting pin portion 217*a* and a connecting portion 217*b*. The connecting pin portion 217*a* and connecting portion 217*b* are provided on the same side of a straight line linking a center of the drive shaft 213 and a enter of the rocker shaft 216*b* as the cam nose 223 of the rocker cam 220 when the variable compression ratio engine 100 is seen from a front surface thereof. The connecting portion 217*b* is positioned farther from the center of the rocker shaft 216*b* than the connecting pin portion 217*a*.

An electric lift modification actuator 250 that displaces the rocker shaft 216*b* by rotating the main shaft portion 216*a* of the control shaft 216 within a predetermined rotation angle range is provided on one end of the control shaft 216.

The lift modification actuator 250 is controlled on the basis of a control signal from a controller 300 that controls the variable compression ratio engine 100 on the basis of a detection result indicating an operational state of the variable compression ratio engine 100. When the control shaft 216 rotates, a center P1 of the rocker shaft 216*b* is rotationally displaced about a center P2 of the main shaft portion 216*a*, whereby an attitude of the rocker arm 217 attached to the rocker shaft 216*b* varies. This variation in the attitude of the rocker arm 217 causes the operating angle or lift of the intake valve 211 to vary. The lift modification actuator 250 corresponds to rocker shaft position modifying means for modifying the operating angle or lift of the intake valve 211 by displacing the rocker shaft 216*b*.

Returning to FIG. 4, a base circle surface 220*a* and a cam surface 220*b* that extends in an arc shape from the base circle surface 220*a* toward the cam nose 223 are formed on the rocker cam 220. The base circle surface 220*a* and cam surface 220*b* contact the valve lifter 219 in accordance with a rocking position of the rocker cam 220. The cam nose 223 is oriented relative to the straight line linking the center of the drive shaft 213 and the center of the rocker shaft 216*b* such that a rotation direction of the rocker cam 220 during opening of the intake valve 211 is identical to a rotation direction of the drive shaft 213.

The axial center P1 of the rocker shaft 216*b* is offset from the axial center P2 of the main shaft portion 216*b* by a predetermined amount. The center P4 of the drive cam 215 is offset from the axial center P3 of the drive shaft 213 by a predetermined amount.

The connecting pin portion 217*a* of the rocker arm 217 penetrates a pin hole 225*c* formed in the projecting portion 225*b* of the link arm 225. As a result, the rocker arm 217 is connected to the link arm 225. The link arm 225 corresponds to a first link that links the rocker arm 217 and the drive cam 215, and an axial center P5 of the connecting pin portion 217*a* that connects the rocker arm 217 and the link arm 225 corresponds to a first connection point.

The connecting portion 217*b* of the rocker arm 217 and the rocker cam 220 are connected by a link member 226. The link member 226 includes a forked first bearing portion 226*a* and a forked second bearing portion 226*b* formed on either end portion thereof.

The first bearing portion 226*a* supports a connecting pin 230 that connects the connecting portion 217*b* of the rocker arm 217 to the link member 226. The connecting portion 217*b* of the rocker arm 217 is disposed between the two prongs of the forked first bearing portion 226*a* of the link member 226.

The second bearing portion 226*b* supports a connecting pin 231 that connects the rocker cam 220 to the link member 226. The rocker cam 220 is disposed between the two prongs of the forked second bearing portion 226*b* of the link member 226.

A snap ring that restricts axial direction movement of the link member 226 is provided on one end of each of the connecting pins 230, 231. The link member 226 corresponds to a second link that links the rocker arm 217 and the rocker cam 220, and an axial center P6 of the connecting pin 230 that connects the rocker arm 217 and the link member 226 corresponds to a second connection point.

Hence, when the variable compression ratio engine 100 is seen from the front surface thereof, or in other words from the same direction as FIG. 4, the axial center P5, which is the connection point between the rocker arm 217 and the link arm 225, and the axial center P6, which is the connection point between the rocker arm 217 and the link member 226, are positioned on the same side of the straight line linking the axial center P3 of the drive shaft 213 and the axial center P1 of the rocker shaft 216*b*, and the axial center P6 is positioned farther from the axial center P1 of the rocker shaft 216*b* than the axial center P5. The cam nose 223 of the rocker cam 220 is provided on the same side of the straight line linking the axial center P3 and the axial center P1 as the axial center P5 and the axial center P6. Further, the cam nose 223 is oriented such that the rotation direction of the rocker cam 220 during opening of the intake valve 211 is identical to the rotation direction of the drive shaft 213.

Next, returning to FIG. 3, the constitution and actions of the variable phase mechanism 240 will be described.

The variable phase mechanism 240 comprises a phase angle modification actuator 241 and a hydraulic device 301.

The phase angle modification actuator 241 rotates the sprocket 242 and the drive shaft 213 relative to each other within a predetermined angle range.

The hydraulic device 301 drives the phase angle modification actuator 241 on the basis of a control signal from the controller 300 that controls the variable compression ratio engine 100 on the basis of a detection result indicating the operational state of the variable compression ratio engine 100.

The hydraulic device 301 supplies oil pressure to the phase angle modification actuator 241 such that the sprocket 242 and the drive shaft 213 are rotated relative to each other, whereby the lift central angle of the intake valve 211 is advanced or retarded.

Next, actions of the variable lift/operating angle mechanism 210 will be described in detail with reference to FIG. 5 to FIG. 9.

When the drive shaft 213 rotates in conjunction with the crankshaft 121, the rocker arm 217 rocks about the axial center P1 of the rocker shaft 216*b* via the drive cam 215 and the link arm 225 fitted onto the outer periphery of the drive cam 215 to be free to rotate. The rocking motion of the rocker arm 217 is transmitted to the rocker cam 220 via the link member 226, causing the rocker cam 220 to rock within a predetermined angle range. When the rocker cam 220 rocks, the valve lifter 219 is pressed such that the intake valve 211 is lifted downward. It is assumed that the drive shaft 213 rotates in the clockwise direction of the figures.

When the control shaft 216 is rotated within a predetermined rotation angle range by the lift modification actuator 250, the position of the axial center P1 of the rocker shaft 216*b*, which serves as a rocking fulcrum of the rocker arm 217, is rotationally varied about the axial center P2 of the main shaft portion 216*a*. As a result, the position in which the rocker arm 217 is supported by the cylinder block 123 varies. When the rocker cam 220 is pulled up by a maximum amount, or in other words when the rocker arm 217 rotates counterclockwise about the rocker shaft 216*b* by a maximum amount, the base circle surface 220*a* is positioned closest to the valve lifter 219, and if this position is set as an initial rocking position of the rocker cam 220, then the initial rocking position varies in accordance with variation in the position of the axial center P1 of the rocker shaft 216*b*. Accordingly, an amount by which the rocker cam 220 must rock in order to reach an initial contact position with the valve lifter 219 when the valve lifter 219 is pushed down varies. Hence, even if a rocking angle of the rocker cam 220 per revolution of the crankshaft remains substantially constant at all times, the amount by which the rocker cam 220 rocks following the start of push-down varies, and as a result, the maximum lift varies as shown in FIGS. 5A to 5D and FIGS. 6A to 6D.

Figures 5A, 5B, 5C, 5D:
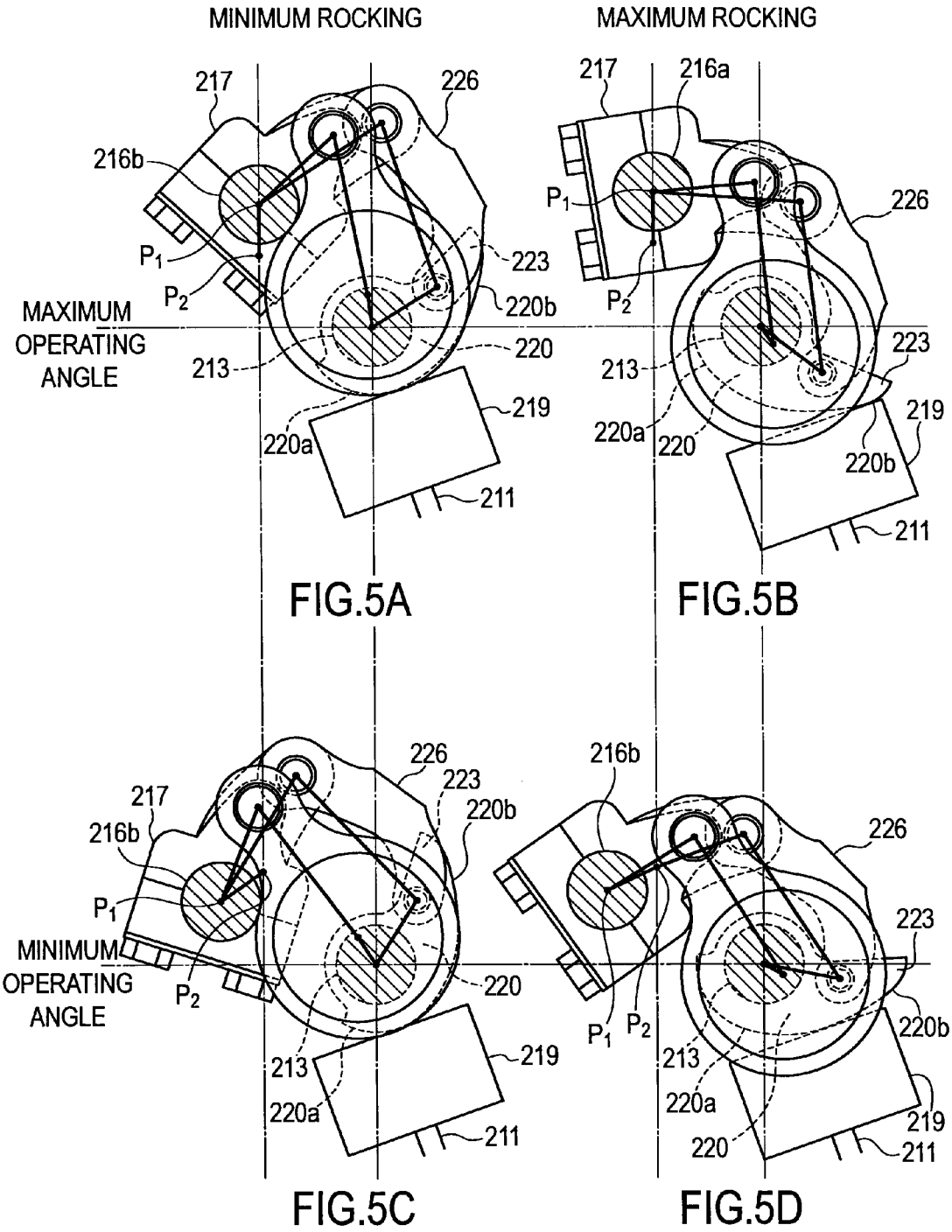
FIGS. 5A to 5D are views showing a minimum rocking position and a maximum rocking position of a rocker cam according to this invention at a maximum operating angle and a minimum operating angle of an intake valve.

FIG. 5A and FIG. 5B show positions of the rocker cam 220 during minimum rocking and maximum rocking in a state where an operating angle of the intake valve 211 is close to a maximum operating angle. FIG. 5C and FIG. 5D show the minimum rocking and maximum rocking positions of the rocker cam 220 in a state where the operating angle of the intake valve 211 is close to a minimum operating angle.

To facilitate understanding of the invention, FIGS. 6A to 6D are views in which the axial centers P1 to P7 and straight lines linking the respective axial centers have been extracted from FIGS. 5A to 5D.

The axial center P1 of the rocker shaft 216*b* moves continuously between a position above the axial center P2 of the main shaft portion 216*a* and a position below and to the left of the axial center P2 by rotating about the axial center P2 of the main shaft portion 216*a*. As shown in FIG. 5A and FIG. 5B or FIG. 6A and FIG. 6B, when the axial center P1 of the rocker shaft 216*b* is positioned above the axial center P2 of the main shaft portion 216*a*, the rocker arm 217 moves clockwise relative to the drive shaft 213 from the state shown in FIG. 5C and FIG. 5D or FIG. 6C and FIG. 6D, in which the operating angle is close to the minimum operating angle, and the link member 226 also moves clockwise.

Accordingly, the cam nose 223 of the rocker cam 220 connected to the link member 226 is pushed greatly downward from the state in which the operating angle is close to the minimum operating angle. As a result, the cam nose 223 inclines in a direction approaching the valve lifter 219 by a larger amount than in the state where the operating angle is close to the minimum operating angle.

Figures 6A, 6B, 6C, 6D:
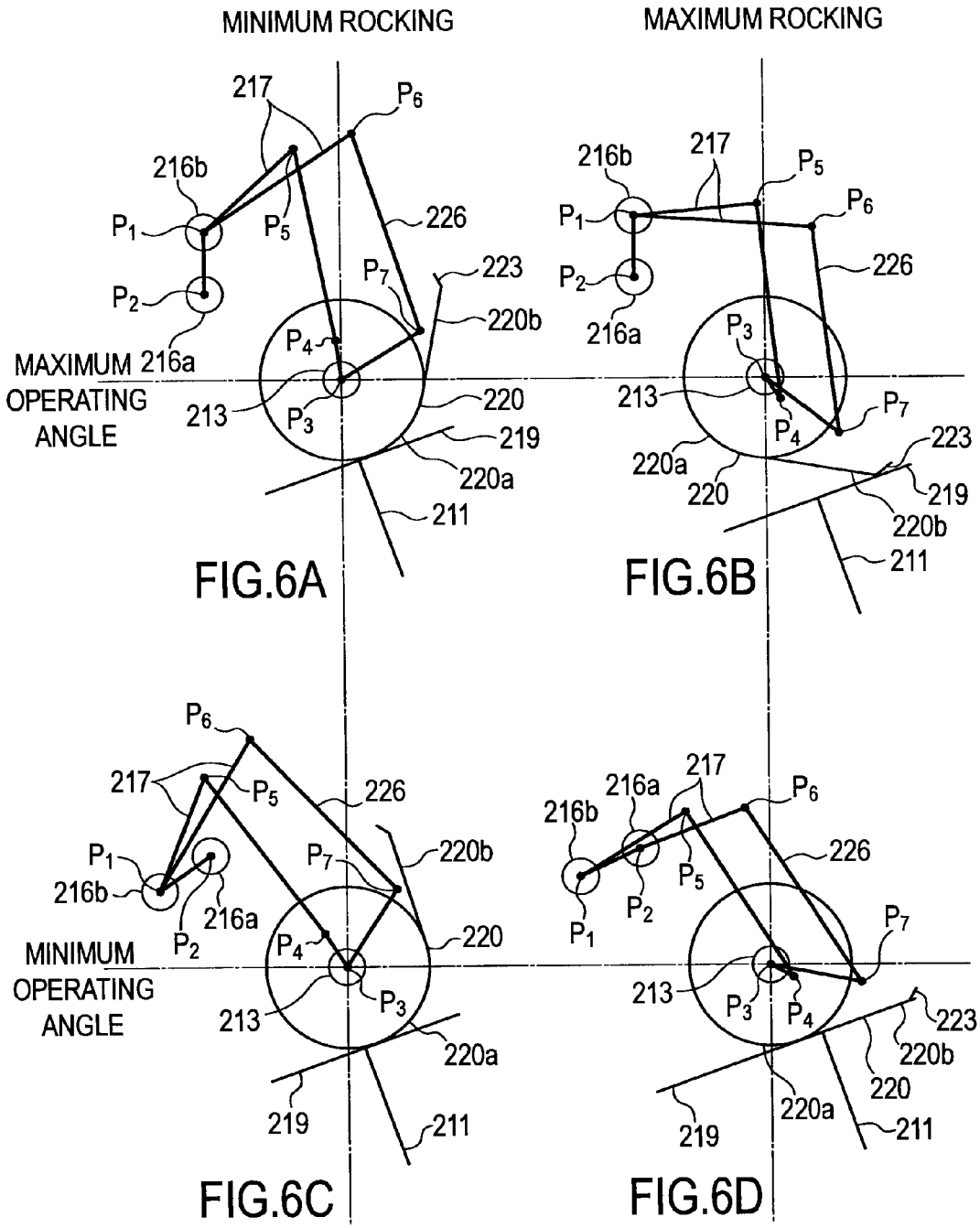
FIGS. 6A to 6D are pattern diagrams illustrating positional relationships between the members shown in FIGS. 5A to 5D.

Hence, an interval between the initial rocking position and the initial contact position of the rocker cam 220 narrows such that when the rocker cam 220 rocks in accordance with rotation of the drive shaft 213, the rocker cam 220 shifts from the base circle surface 220*a* to the cam surface 220*b* immediately. Accordingly, as shown in FIG. 5B or FIG. 6B, the maximum lift of the intake valve 211 increases in comparison with the state in which the operating angle is close to the minimum operating angle. As a result, a crank angle interval from an opening timing to a closing timing of the intake valve 211, or in other words the operating angle of the intake valve 211, also increases.

Meanwhile, when the control shaft 216 is rotated such that the axial center P1 of the rocker shaft 216*b* is positioned below and to the left of the axial center P2 of the main shaft portion 216*a*, as shown in FIG. 5C and FIG. 5D or FIG. 6C and FIG. 6D, the entire rocker arm 217 moves to a side to which it rotates in the counter-clockwise direction about the drive shaft from the state shown in FIG. 5A and FIG. 5B or FIG. 6A and FIG. 6B, in which the operating angle is close to the maximum operating angle, and as a result, the link member 226 also moves to a side to which it rotates in the counter-clockwise direction.

Accordingly, the cam nose 223 of the rocker cam 220 connected to the link member 226 is pulled further upward in comparison with the state in which the operating angle is close to the maximum operating angle. As a result, the cam surface 220*b* inclines further in a direction heading away from the valve lifter 219 than in the state where the operating angle is close to the maximum operating angle, as shown in FIG. 5C or FIG. 6C.

Hence, the interval between the initial rocking position and the initial contact position of the rocker cam 220 widens such that when the rocker cam 220 rocks in accordance with rotation of the drive shaft 213, the base circle surface 220*a* remains close to the valve lifter 219 for a long time, thereby shortening the period of contact between the cam surface 220*b* and the valve lifter. Accordingly, as shown in FIG. 5D or FIG. 6D, the maximum lift of the intake valve 211 decreases in comparison with the state in which the operating angle is close to the maximum operating angle. As a result, the operating angle of the intake valve 211 also decreases.

Figure 7:
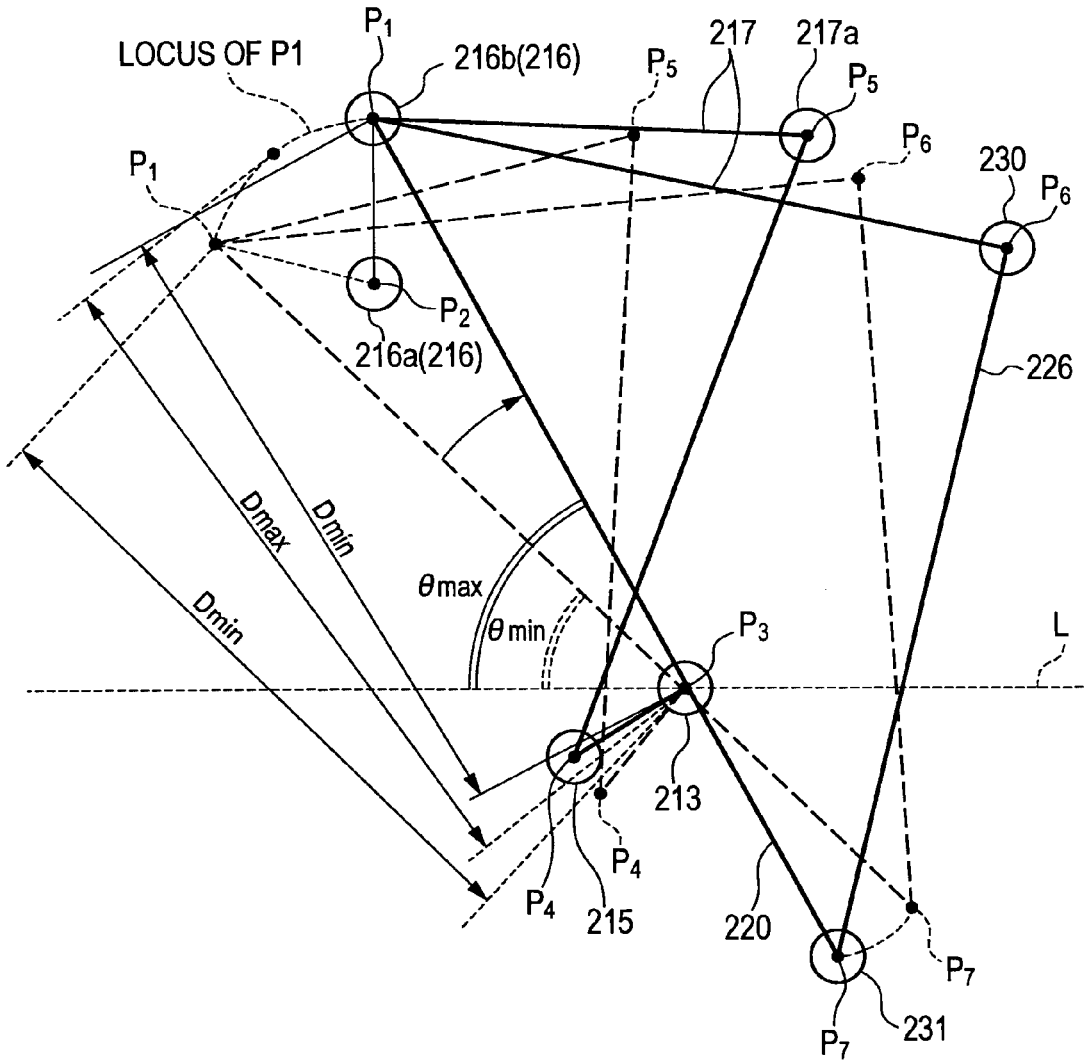
FIG. 7 is a pattern diagram illustrating positional relationships between axial centers P1 to P7 of the variable lift/operating angle mechanism.

FIG. 7 shows the axial centers P1 to P7 of the variable lift/operating angle mechanism 210 and straight lines linking the respective axial centers. In FIG. 7, broken lines indicate the state in which the operating angle is close to the minimum operating angle and solid lines indicate the state in which the operating angle is close to the maximum operating angle.

Hereafter, a line segment linking the axial center P1 of the rocker shaft 216*b* and the axial center P3 of the drive shaft 213 will be referred to as a "line segment P1P3". Further, the distance between the axial center P1 and the axial center P3 will be referred to as an "inter-fulcrum distance D". Furthermore, an angle formed by the line segment P1P3 and an imaginary line L passing through the axial center P3, which is indicated by a dotted line in the drawing, will be referred to as an "inter-fulcrum angle θ".

As shown in FIG. 7, when the axial center P1 of the rocker shaft 216*b* is moved on a circle centering on the axial center P2 of the main shaft portion 216*a* by rotating the control shaft 216 within a predetermined rotation angle range in order to vary the operating angle or lift from the minimum operating angle to the maximum operating angle, both the inter-fulcrum angle θ and the inter-fulcrum distance D vary.

In other words, with the variable lift/operating angle mechanism 210 according to this embodiment, when the operating angle or the lift is varied from the minimum operating angle to the maximum operating angle, the inter-fulcrum angle θ increases gradually from θmin to θmax.

Meanwhile, from the minimum operating angle to an intermediate operating angle, the inter-fulcrum distance D increases gradually from Dmin. to Dmax. Then, from the intermediate operating angle to the maximum operating angle, the inter-fulcrum distance D decreases gradually from Dmax to Dmin, thereby returning to a substantially identical length to the inter-fulcrum distance at the minimum operating angle.

Figure 8A:
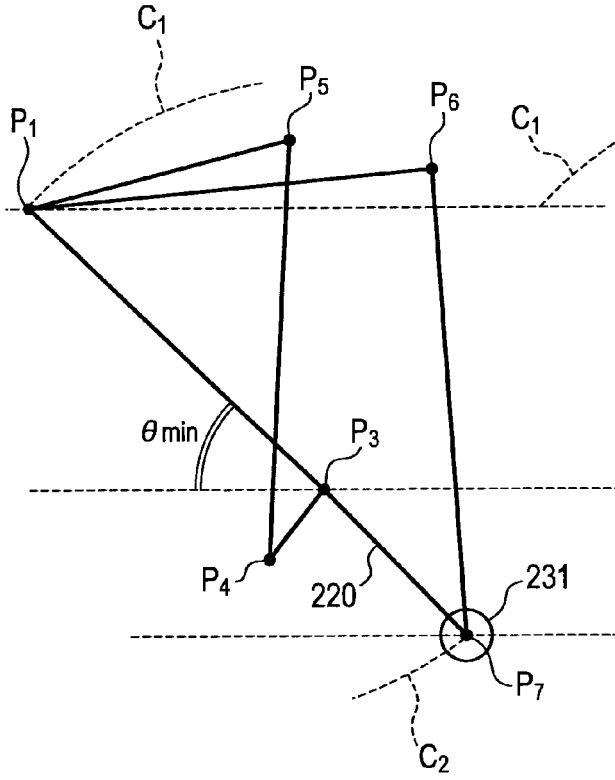
FIGS. 8A and 8B are pattern diagrams illustrating the axial centers P1 to P7 at the minimum operating angle and the maximum operating angle.
Figure 8B:
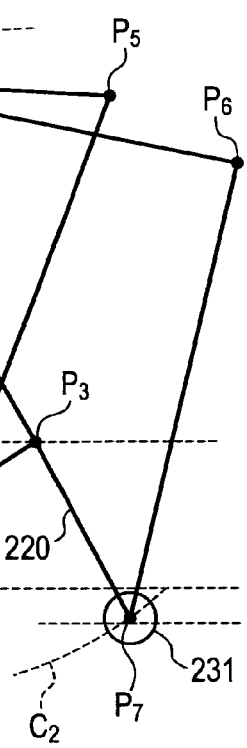

Referring to FIG. 8A and FIG. 8B, actions generated when the inter-fulcrum angle θ is varied while keeping the inter-fulcrum distance D at an identical length will be described. Then, referring to FIG. 9A and FIG. 9B, actions generated when the inter-fulcrum distance D is varied while keeping the inter-fulcrum angle θ at an identical angle will be described.

FIG. 8A shows the minimum operating angle. FIG. 8B shows the maximum operating angle.

As shown in FIG. 8A and FIG. 8B, when the inter-fulcrum angle θ is varied from θmin to θmax while keeping the inter-fulcrum distance D at an identical length, the axial center P1 moves upward in a clockwise direction around a circumference C1 centering on the axial center P3. Meanwhile, the axial center P7 moves downward in a clockwise direction around a circumference C2 centering on the axial center P3. In other words, the position of the connecting pin 231 connected to the cam nose of the rocker cam 220 moves downward.

As a result, the initial contact position and the initial rocking position of the rocker cam 220 relative to the valve lifter 219 approach each other, thereby increasing the operating angle of the intake valve 211.

Hence, when the inter-fulcrum angle θ is increased while keeping the inter-fulcrum distance D at an identical length, the operating angle of the intake valve 211 increases.

Figure 9A:
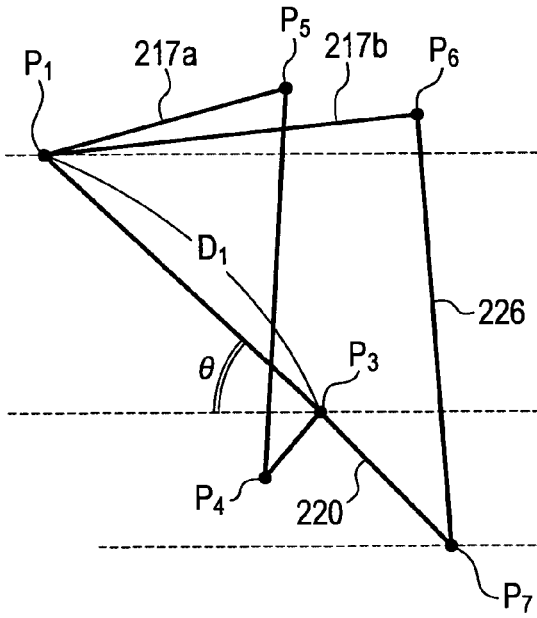
FIGS. 9A and 9B are pattern diagrams illustrating the axial centers P1 to P7 of two variable valve devices having different inter-fulcrum distances D.
Figure 9B:
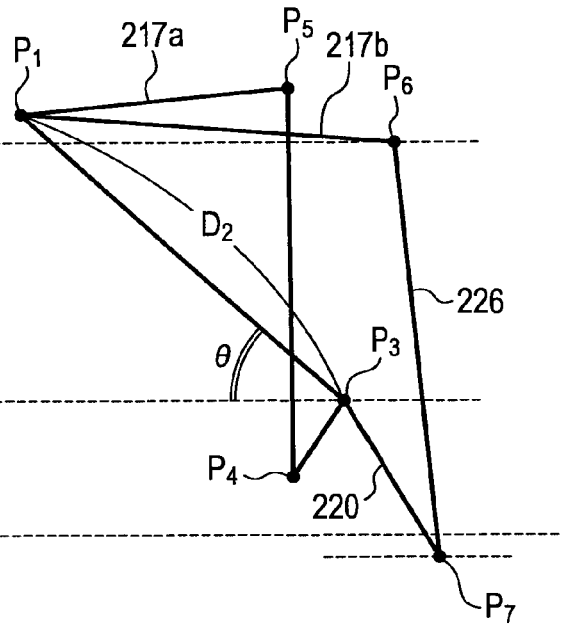

FIG. 9A and FIG. 9B are views comparing the axial centers P1 to P7 and straight lines linking the respective axial centers of two variable valve devices in which the inter-fulcrum distance D differs but the dimensions of all other parts, such as inter-axial distances, are identical, the two variable valve devices being shown in a state where the rotation angle positions of the respective drive shafts 213 are substantially identical. The inter-fulcrum angles θ in FIG. 9A and FIG. 9B are identical, but an inter-fulcrum distance D1 in FIG. 9A is shorter than an inter-fulcrum distance D2 in FIG. 9B.

As shown in FIG. 9A and FIG. 9B, when the inter-fulcrum distance D is long, the axial center P1 of the rocker shaft 216*b* is positioned further upward and removed from the drive shaft center P3 than when the inter-fulcrum distance D is short. Accordingly, the respective positions of the center P3 of the drive shaft and the center P4 of the drive cam and the respective lengths of the line segment P1P5 and the line segment P5P4 are equal, and therefore an angle formed by the line segment P1P5 and the line segment P5P4 increases when the inter-fulcrum distance D is lengthened. Hence, when the inter-fulcrum distance D is lengthened, an incline of the line segment P1P5 varies similarly to a case in which the line segment P1P5 is rotated clockwise. In accordance with the principle of leverage, the axial center P1 moves upward while the position of the axial center P5 does not vary greatly, and therefore at this time, the axial center P6, which is further removed from the rocker shaft center P3 than the axial center P5, moves downward in the figures.

As a result, the axial center P7 of the connecting pin 231 that connects the link member 226 to the cam nose of the rocker cam 220 is pushed relatively downward, and therefore the initial contact position and initial rocking position of the rocker cam 220 relative to the valve lifter 219 approach each other. As a result, the operating angle of the intake valve 211 increases.

Hence, when the inter-fulcrum distance D is increased while keeping the inter-fulcrum angle θ at an identical angle, the operating angle of the intake valve 211 increases.

As described above, by varying the inter-fulcrum angle θ and the inter-fulcrum distance D, the variable lift/operating angle mechanism 210 varies the operating angle of the intake valve 211.

Next, actions of the variable lift/operating angle mechanism 210 according to this embodiment will be described.

Figure 10:
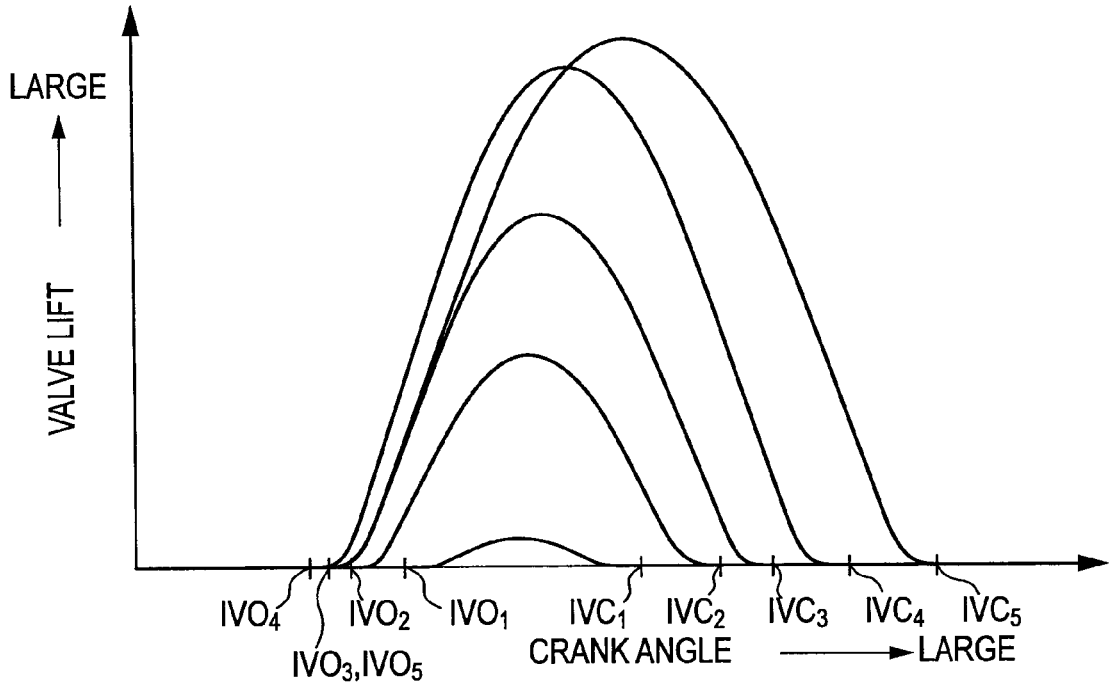
FIG. 10 is a view showing a valve lift characteristic of the intake valve variable valve device according to this invention.
Figure 11:
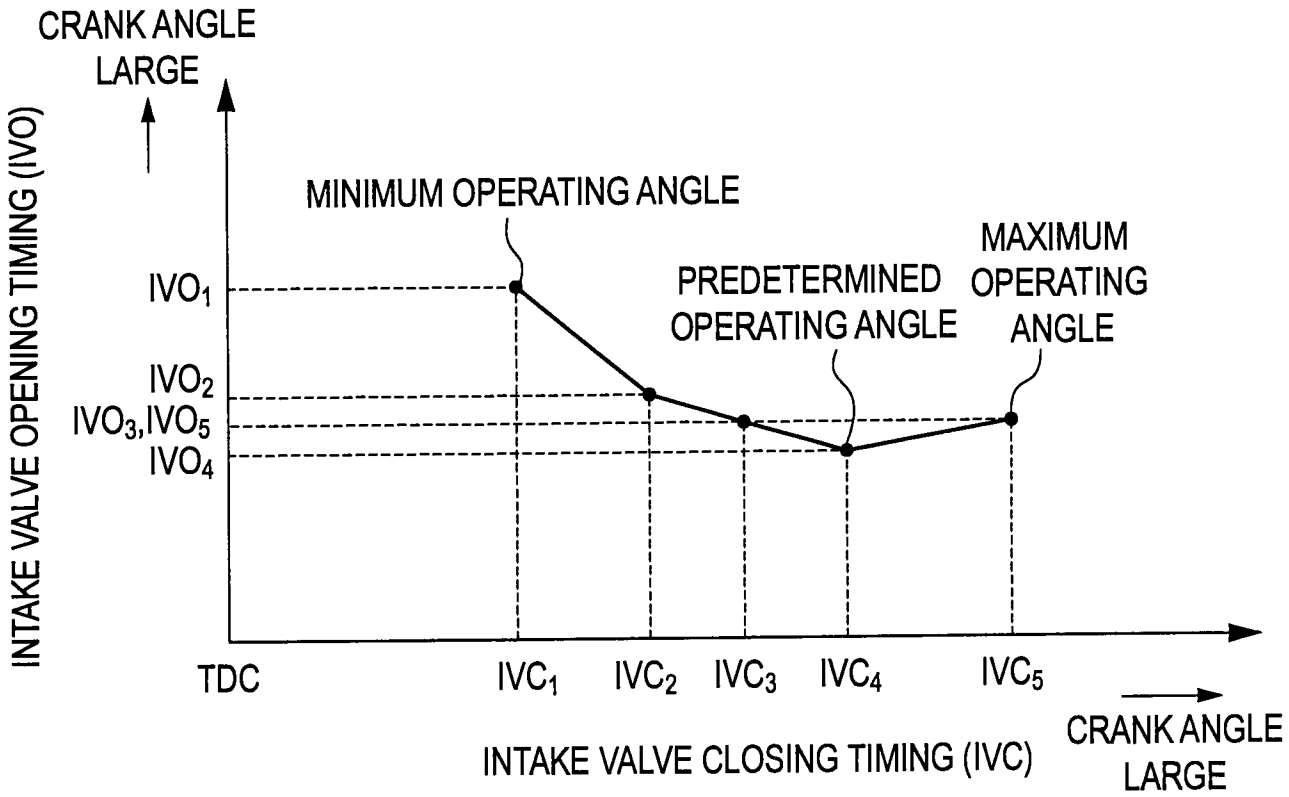
FIG. 11 is a view showing a relationship between an intake valve opening timing and an intake valve closing timing of the intake valve variable valve device according to this invention.

FIG. 10 shows a valve lift characteristic of the variable lift/operating angle mechanism 210. FIG. 11 shows a relationship between an intake valve opening timing (Intake Valve Open; to be referred to as "NO" hereafter) and an intake valve closing timing (Intake Valve Close; to be referred to as "IVC" hereafter) at each of the valve lift characteristics shown in FIG. 10. Both figures show states in which the valve lift characteristic is varied by the variable lift/operating angle mechanism 210 alone, without modification of the lift central angle of the intake valve 211 by the variable phase mechanism 240.

As shown in FIG. 10 and FIG. 11, when the operating angle is varied from the minimum operating angle to the maximum operating angle, the NO is advanced as the operating angle increases from the minimum operating angle to a predetermined operating angle, as in the prior art. However, from the predetermined operating angle to the maximum operating angle, it is possible to suppress IVO movement in an advancement direction or retard the IVO as the operating angle increases.

The reason for this is that when the operating angle is varied from the minimum operating angle to the maximum operating angle, the inter-fulcrum distance D increases gradually from the minimum operating angle to an intermediate operating angle and then gradually decreases from the intermediate operating angle to the maximum operating angle.

In other words, when the operating angle is varied from the minimum operating angle to the maximum operating angle, the inter-fulcrum angle θ increases, causing the operating angle to increase, and as a result, the IVO advances. Further, from the minimum operating angle to the intermediate operating angle, the inter-fulcrum distance D lengthens, causing the operating angle to increase, and as a result, the IVO advances.

Hence, from the minimum operating angle to the intermediate operating angle, the inter-fulcrum angle θ and the inter-fulcrum distance D both increase, and as a result, the operating angle increases, leading to advancement of the IVO.

However, from the intermediate operating angle to the maximum operating angle, the inter-fulcrum distance D decreases while the inter-fulcrum angle θ continues to increase. Although the IVO advances due to the increase in the inter-fulcrum angle θ, the operating angle decreases due to the reduction in the inter-fulcrum distance D, and as a result, the IVO is retarded correspondingly.

Therefore, from the intermediate operating angle to the maximum operating angle, it is possible to suppress IVO movement in the advancement direction or retard the IVO while increasing the operating angle. When the operating angle or lift of the intake valve 211 increases, the lift/operating angle center moves to an advancement side, and an amount by which the lift/operating angle center moves toward a retardation side relative to the increase in the operating angle or lift is larger in a range where the operating angle or lift is greater than a predetermined operating angle or lift than in a range where the operating angle or lift is smaller than the predetermined operating angle or lift.

Hence, according to the intake valve variable valve device 200, a valve characteristic whereby IVO movement in the advancement direction is suppressed and the IVO is retarded when the operating angle increases in the vicinity of the maximum operating angle can be obtained. As a result, the proximity of the valve and the piston when the intake valve 211 is at the maximum operating angle and the lift central angle is maximally advanced can be reduced. At the minimum operating angle, meanwhile, the IVO is retarded in comparison with the IVO at the intermediate operating angle. In other words, advancement of the overall operating angle range is suppressed, and therefore the IVC is likewise held on the retardation side. Accordingly, the IVC can be delayed until the latest possible timing of an intake stroke and thereby prevented from departing from bottom dead center for as long as possible, and as a result, a sufficient amount of inflowing air into the cylinders is secured, particularly during start-up, leading to an improvement in startability.

A valve recess of the piston is provided at a depth having a fixed margin, taking typical failures of the intake valve variable valve device 200 into consideration and using a state of maximum interference between the valve and the piston as a reference. By reducing the possibility of interference between the valve and the piston in a state where the intake valve 211 is at the maximum operating angle and the lift central angle is maximally advanced, as in the intake valve variable valve device 200, a surface area of the valve recess can be reduced. In so doing, cooling loss can be reduced. Moreover, an increase in combustion efficiency, leading to an improvement in fuel efficiency, can be achieved.

Figure 12:
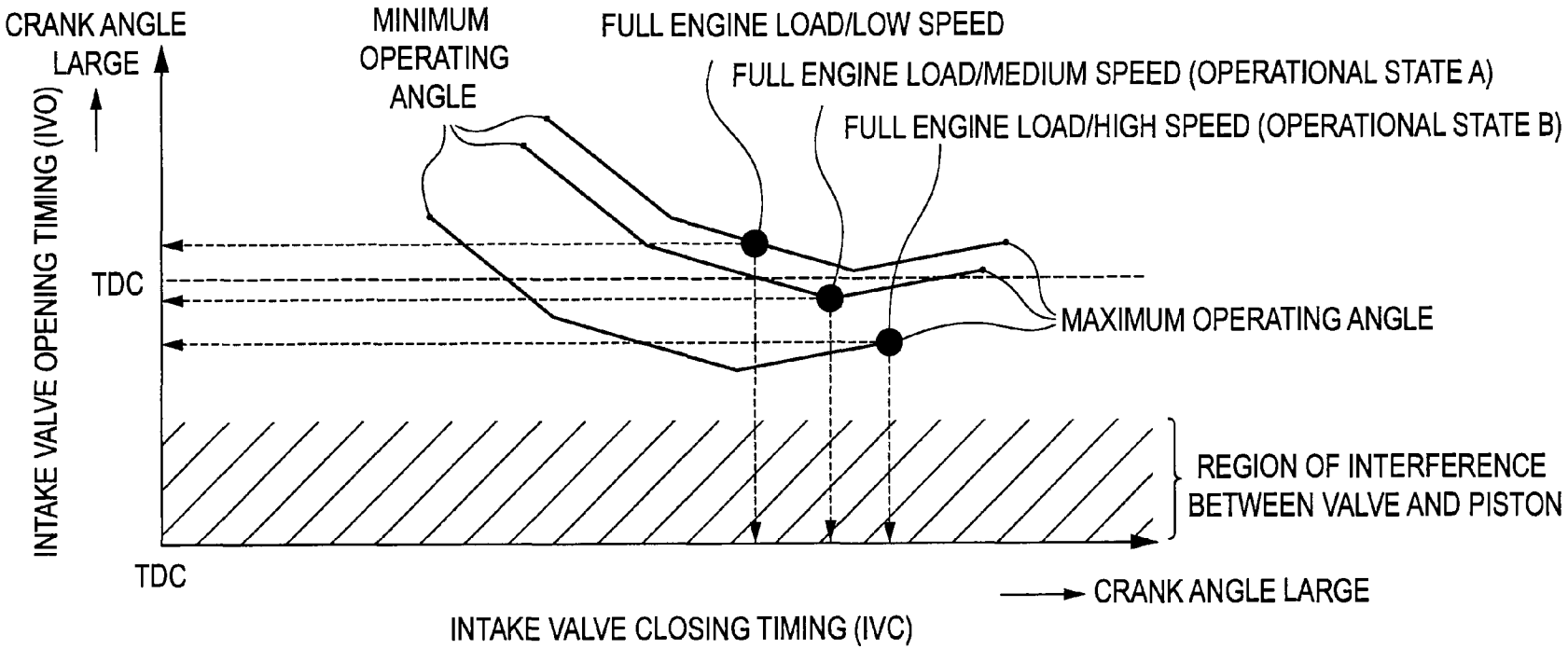
FIG. 12 is a view showing the relationship between the intake valve opening timing and the intake valve closing timing in various operational states of the intake valve variable valve device according to this invention.
Figure 13:
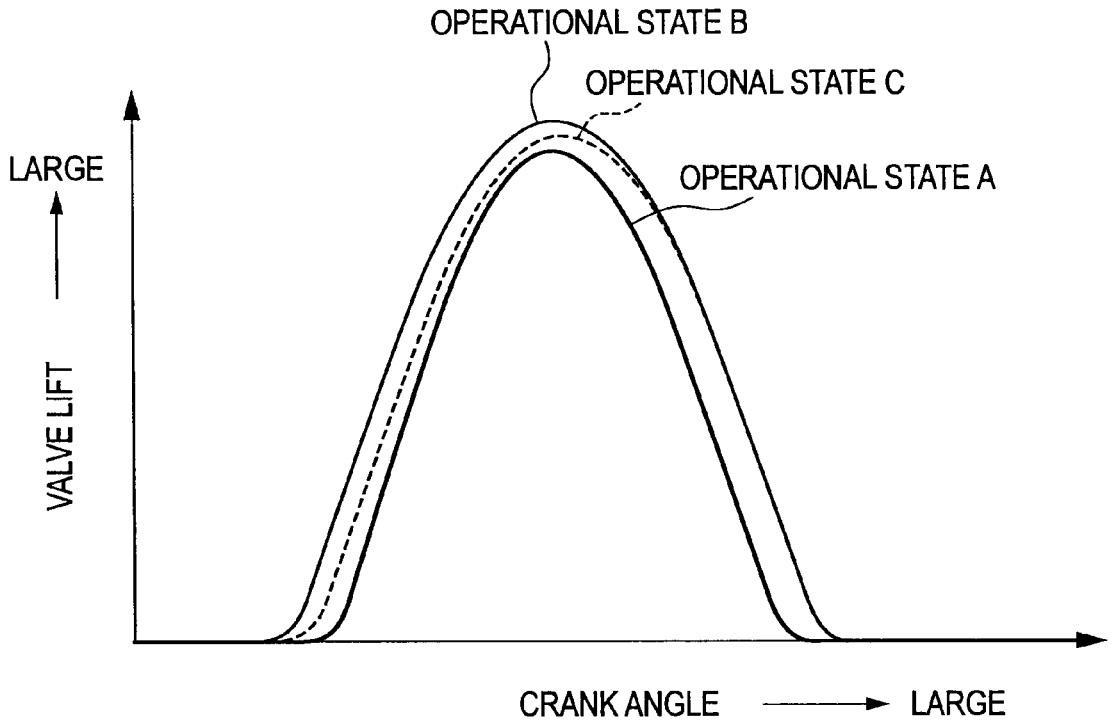
FIG. 13 is a view illustrating control of the intake valve variable valve device according to this invention.
Figure 14:
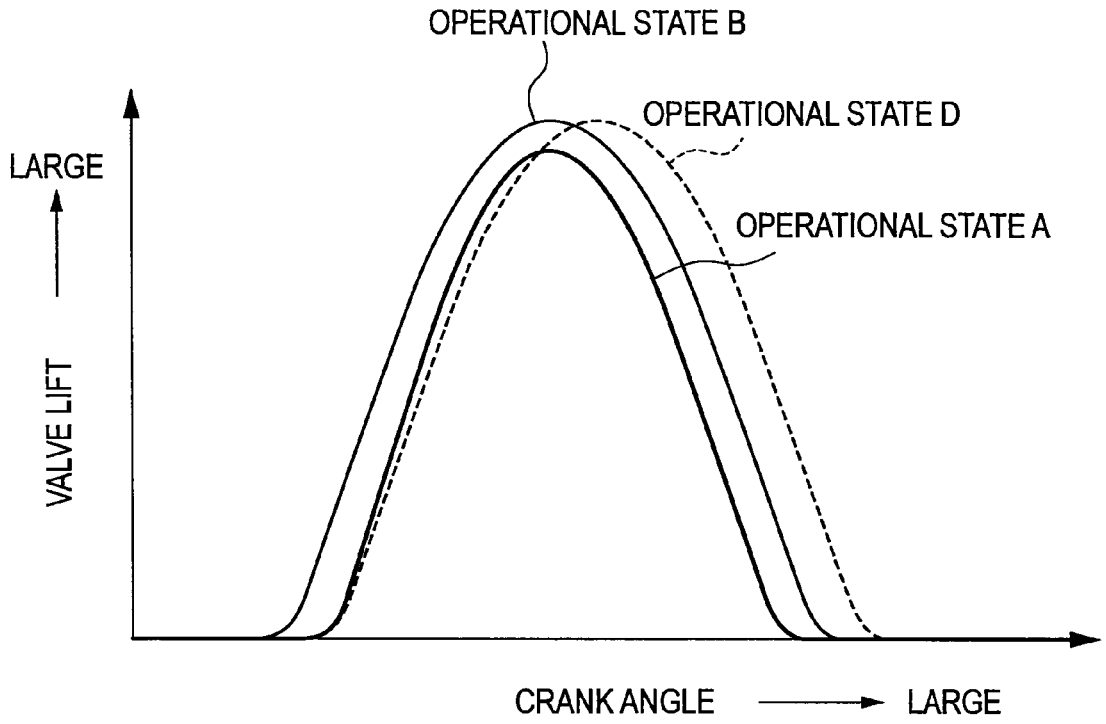
FIG. 14 is a view illustrating control of the intake valve variable valve device according to this invention.

Referring to FIGS. 12 to 14, control of the intake valve variable valve device 200 will be described.

FIG. 12 is a control map for determining the IVO and the IVC in accordance with operational states. This map is stored in the controller 300 in advance.

During a full engine load/low speed operation, the operating angle is set at an intermediate operating angle between the minimum operating angle and the maximum operating angle, and the IVO is set after top dead center. During a full engine load/medium speed operation, or in other words in an operational state A, the operating angle is increased beyond that of the full engine load/low speed operation by the variable lift/operating angle mechanism, and the IVO is set before top dead center by the variable phase mechanism. During a full engine load/high speed operation, or in other words in an operational state B, the operating angle is set at the maximum operating angle by the variable lift/operating angle mechanism, and the IVO is set further toward the advancement side than during the full engine load/medium speed operation by the variable phase mechanism.

When the operational state shifts from A to B or from B to A, the following control is executed.

When the operational state shifts from A to B, or in other words when the vehicle is in an accelerating state, driving of the variable phase mechanism 240 is prohibited at a valve timing at which the operating angle increases and the IVO advances, and only the variable lift/operating angle mechanism 210 is driven until the IVC reaches a target IVC. Once the IVC has reached the target IVC, coordinated control in which the variable lift/operating angle mechanism 210 and the variable phase mechanism 240 are driven simultaneously is implemented to control the valve timing of the intake valve 211 to an optimum valve timing.

More specifically, as shown in FIG. 13, at first only the variable lift/operating angle mechanism 210 is driven. Then, when the operational state shifts from A to C such that the IVC reaches the target IVC, the variable lift/operating angle mechanism 210 and the variable phase mechanism 240 are driven simultaneously, whereby the operational state shifts to B.

The variable lift/operating angle mechanism 210 is driven by the electric lift modification actuator 250, and therefore has a faster response speed than the hydraulically driven variable phase mechanism 240. Hence, during acceleration, the variable lift/operating angle mechanism 210 is driven first to cause the IVC to reach the target IVC quickly, thereby preventing a situation in which the IVC is transiently retarded from the target IVC. In so doing, a reduction in charging efficiency, leading to deterioration of the operating performance, can be prevented.

On the other hand, when the operational state shifts from B to A, or in other words when the vehicle is in a decelerating state, driving of the variable lift/operating angle mechanism 210 is prohibited at a valve timing at which the operating angle decreases and the NO is retarded, and the variable phase mechanism 240 is driven preferentially until the IVO reaches a target IVO. Once the NO has reached the target NO, coordinated control is implemented in the variable lift/operating angle mechanism 210 and the variable phase mechanism 240 to control the valve timing of the intake valve 211 to the optimum valve timing.

More specifically, as shown in FIG. 14, at first only the variable phase mechanism 240 is driven. Then, when the operational state shifts from B to D such that the IVO reaches the target IVO, the variable lift/operating angle mechanism 210 and the variable phase mechanism 240 are driven simultaneously, whereby the operational state shifts to A.

If the variable lift/operating angle mechanism 210 is mistakenly driven at the valve timing at which the operating angle decreases and the NO advances, the NO is advanced excessively. In this case, the valve recess must be enlarged to avoid interference between the valve and the piston, leading to deterioration of the cooling performance and so on.

By driving the variable phase mechanism 240 first in this operational state and then implementing coordinated control in the variable lift/operating angle mechanism 210 and the variable phase mechanism 240 once the IVO has reached the target IVO, excessive advancement of the NO can be prevented. As a result, cooling loss and other deteriorations can be prevented.

According to the embodiment described above, the valve lift characteristic of the intake valve can be set such that from the predetermined operating angle to the maximum operating angle, the operating angle increases and intake valve opening timing movement in the advancement direction is suppressed or the intake valve opening timing is retarded.

Thus, the proximity of the valve and the piston when the intake valve 211 is at the maximum operating angle and the lift central angle is maximally advanced can be reduced. As a result, the surface area of the valve recess can be reduced, leading to a reduction in cooling loss. Moreover, an increase in combustion efficiency, leading to an improvement in fuel efficiency, can be achieved.

Furthermore, when the vehicle is in an accelerating state, driving of the variable phase mechanism 240 is prohibited at a valve timing at which the operating angle increases and the IVO is retarded, and only the variable lift/operating angle mechanism 210 is driven until the IVC reaches the target IVC.

Hence, during acceleration, the variable lift/operating angle mechanism 210, which exhibits favorable operation responsiveness, is driven first to cause the IVC to reach the target IVC quickly, thereby preventing a situation in which the IVC is transiently retarded from the target IVC. In so doing, a reduction in charging efficiency, leading to deterioration of the operating performance, can be prevented.

Further, when the vehicle is in a decelerating state, driving of the variable lift/operating angle mechanism 210 is prohibited at a valve timing at which the operating angle increases and the IVO is retarded, or in other words a valve timing at which the operating angle decreases and the IVO advances, and the variable phase mechanism 240 is driven preferentially until the IVO reaches the target IVO.

Hence, excessive advancement of the IVO can be prevented. As a result, cooling loss and other deteriorations can be prevented.

Moreover, in the case of a variable compression ratio engine, a ratio (to be referred to hereafter as an "S/V ratio") between a combustion chamber volume and a surface area increases as the compression ratio increases, leading to an increase in cooling loss. However, by incorporating the variable lift/operating angle mechanism 210 according to this embodiment, the surface area of the valve recess can be reduced, leading to a reduction in the surface area. As a result, increases in the S/V ratio accompanying increases in compression can be suppressed, enabling a reduction in cooling loss.

It should be noted that this invention is not limited to the embodiment described above, and may of course be subjected to various modifications within the scope of the technical spirit thereof.

For example, an operating angle or lift range in which the operating angle increases and intake valve opening timing movement in the advancement direction is suppressed or the intake valve opening timing is retarded may be provided in a range other than the vicinity of the maximum operating angle in accordance with requirements, such as when the device described in the above embodiment is combined with a variable phase mechanism that works differently in accordance with the device. Further, the variable valve device according to this invention may be applied to an exhaust valve and used to reduce the proximity of the exhaust valve and the piston by suppressing variation in the closing timing of the exhaust valve.

With respect to the above description, Patent Application 2007-209706, with a filing date of Aug. 10, 2007 in Japan, Patent Application 2007-214529, with a filing date of Aug. 21, 2007 in Japan, Patent Application 2008-43126, with a filing date of Feb. 25, 2008 in Japan, and Patent Application 2008-47918, with a filing date of Feb. 28, 2008 in Japan, are incorporated herein by reference.

INDUSTRIAL APPLICABILITY

As described above, this invention exhibits particularly favorable effects when applied to an internal combustion engine having greatly varying operating conditions.

Exclusive properties or features encompassed by the embodiments of this invention are as claimed below.

The invention claimed is:

1. A variable valve device comprising:

a drive shaft that rotates in synchronization with a crankshaft of an internal combustion engine;

a drive cam provided on the drive shaft;

a rocker cam pivotally supported on the drive shaft;

an engine valve that is driven to open and close by the rocker cam;

a rocker shaft disposed parallel to the drive shaft;

a rocker arm pivotally supported on the rocker shaft;

a first link that links the rocker arm and the drive cam;

a second link that links the rocker aim and the rocker cam; and a rocker shaft position modifying section that modifies a position of the rocker shaft relative to the drive shaft to control an operating angle or a lift of the engine valve, wherein an opening timing of the engine valve, which is a time at which the engine valve starts to open, is retarded as the operating angle or lift of the engine valve increases.

2. The variable valve device as defined in claim 1, wherein the opening timing of the engine valve is retarded as the operating angle or lift of the engine valve increases by shortening a distance between a center of the drive shaft and a center of the rocker shaft as the operating angle or lift of the engine valve increases.

3. The variable valve device as defined in claim 1, wherein the opening timing of the engine valve is retarded as the operating angle or lift of the engine valve increases while the operating angle or lift of the engine valve is controlled within a predetermined operating angle range or lift range.

4. The variable valve device as defined in claim 3, wherein the predetermined operating angle range or lift range is from a predetermined operating angle or lift to a maximum operating angle or lift.

5. An internal combustion engine for a vehicle comprising the variable valve device as claimed in claim 1, wherein the variable valve device comprises a phase modifying section that modifies a center phase of the operating angle of the engine valve continuously, the engine valve is an intake valve, and the internal combustion engine further comprises a controller that drives the rocker shaft position modifying section and prohibits driving of the phase modifying section during vehicle acceleration until an intake valve closing timing reaches a target intake valve closing timing.

6. The internal combustion engine as defined in claim 5, wherein, once the intake valve closing timing has reached the target intake valve closing timing during vehicle acceleration, the controller drives the rocker shaft position modifying section and the phase modifying section simultaneously to control the operating angle to a target operating angle while keeping the intake valve closing timing fixed at the target intake valve closing timing.

7. The internal combustion engine as defined in claim 5, wherein during vehicle deceleration, the controller drives the phase modifying section and prohibits driving of the rocker shaft position modifying section until an intake valve opening timing reaches a target intake valve opening timing.

8. The internal combustion engine as defined in claim 7, wherein, once the intake valve opening timing has reached the target intake valve opening timing during vehicle deceleration, the controller drives the rocker shaft position modifying section and the phase modifying section simultaneously to control the operating angle to the target operating angle while keeping the intake valve opening timing fixed at the target intake valve opening timing.

9. The internal combustion engine as defined in claim 5, wherein the controller prohibits driving of the phase modifying section when a target operating angle or lift is between a predetermined operating angle or lift and a maximum operating angle or lift.

10. The internal combustion engine as defined in claim 5, wherein the controller prohibits driving of the phase modifying section during a full engine load operation.

11. A variable valve device comprising:

a drive shaft that rotates in synchronization with a crankshaft of an internal combustion engine;

a drive cam provided on the drive shaft;

a rocker cam pivotally supported on the drive shaft;

an engine valve that is driven to open and close by the rocker cam;

a rocker shaft disposed parallel to the drive shaft;

a rocker arm pivotally supported on the rocker shaft;

a first link that links the rocker arm and the drive cam;

a second link that links the rocker arm and the rocker cam; and a rocker shaft position modifying section that modifies a position of the rocker shaft relative to the drive shaft to control an operating angle or a lift of the engine valve, wherein while the operating angle or lift of the engine valve is controlled within a predetermined operating angle range or lift range, variation in an opening timing of the engine valve is suppressed by displacing the rocker shaft relative to the drive shaft such that, when viewed from a front surface of the engine, an opening timing variation of the engine valve accompanying angular variation in a straight line linking a center of the drive shaft and a center of the rocker shaft and an opening timing variation of the engine valve accompanying variation in a distance between the center of the drive shaft and the center of the rocker shaft cancel each other.

12. The variable valve device as defined in claim 11, wherein, when viewed from a front surface of the engine, a first connection point serving as a connecting portion between the rocker arm and the first link and a second connection point serving as a connecting portion between the rocker arm and the second link are on a same side of the straight line linking the center of the drive shaft and the center of the rocker shaft, the second connection point being positioned farther from the center of the rocker shaft than the first connection point, the rocker cam includes a cam nose positioned on the same side of the straight line as the first connection point and the second connection point, and a rotation direction of the drive shaft is equal to a rotation direction of the rocker cam during opening of the engine valve.

13. The variable valve device as defined in claim 12, wherein when the operating angle or lift of the engine valve is increased, variation in the opening timing of the engine valve is suppressed by rotating the straight line in a same direction as the rotation direction of the drive shaft and reducing the distance between the center of the drive shaft and the center of the rocker shaft.

14. The variable valve device as defined in claim 12, wherein when the operating angle or lift of the engine valve is increased, an advancement of the opening timing of the engine valve accompanying angular variation in the straight line and a retardation of the opening timing of the engine valve accompanying variation in the distance cancel each other such that variation in the opening timing of the engine valve is suppressed.

15. The variable valve device as defined in claim 14, wherein in a part of the predetermined operating angle range or lift range, an amount by which the opening timing of the engine valve is retarded in accordance with variation in the distance exceeds an amount by which the opening timing of the engine valve is advanced in accordance with angular variation in the straight line such that the opening timing of the engine valve is retarded in accordance with an increase in the operating angle or lift of the engine valve.

16. The variable valve device as defined in claim 11, wherein the predetermined operating angle range or lift range is from a predetermined operating angle or lift to a maximum operating angle or lift.

17. An internal combustion engine for a vehicle comprising the variable valve device as claimed in claim 11, wherein the variable valve device comprises a phase modifying section that modifies a center phase of the operating angle of the engine valve continuously, the engine valve is an intake valve, and the internal combustion engine further comprises a controller that drives the rocker shaft position modifying section and prohibits driving of the phase modifying section during vehicle acceleration until an intake valve closing timing reaches a target intake valve closing timing.

18. A variable valve device comprising:

a drive shaft that rotates in synchronization with a crankshaft of an internal combustion engine;

a drive cam provided on the drive shaft;

a rocker cam pivotally supported on the drive shaft;

an engine valve that is driven to open and close by the rocker cam;

a rocker shaft disposed parallel to the drive shaft;

a rocker arm pivotally supported on the rocker shaft;

a first link that links the rocker arm and the drive cam;

a second link that links the rocker arm and the rocker cam; and a rocker shaft position modifying section that modifies a position of the rocker shaft relative to the drive shaft to control an operating angle or a lift of the engine valve, wherein when the operating angle or lift of the engine valve increases, a lift/operating angle center moves toward a retardation side, and an amount by which the lift/operating angle center moves toward the retardation side relative to the increase in the operating angle or lift in a range where the operating angle or lift is greater than a predetermined operating angle or lift is larger than the amount in a range where the operating angle or lift is smaller than the predetermined operating angle or lift.

19. An internal combustion engine for a vehicle comprising the variable valve device as claimed in claim 18, wherein the variable valve device comprises a phase modifying section that modifies a center phase of the operating angle of the engine valve continuously, the engine valve is an intake valve, and the internal combustion engine further comprises a controller that drives the rocker shaft position modifying section and prohibits driving of the phase modifying section during vehicle acceleration until an intake valve closing timing reaches a target intake valve closing timing.

* * * * *